US007750571B2

(12) United States Patent
Muckel et al.

(10) Patent No.: US 7,750,571 B2
(45) Date of Patent: Jul. 6, 2010

(54) INCREASING THE DISCHARGE ARC DIFFUSENESS IN MERCURY-FREE DISCHARGE LAMPS

(75) Inventors: Ralf Muckel, Aachen (DE); Jürgen Schoeneich, Stolberg (DE); Georg Haselhorst, Roetgen (DE); Michael Haacke, Aachen (DE)

(73) Assignee: Koninklijke Philips Electronics, N.V., Eindhoven (NL)

( * ) Notice: Subject to any disclaimer, the term of this patent is extended or adjusted under 35 U.S.C. 154(b) by 0 days.

(21) Appl. No.: 10/524,406

(22) PCT Filed: Aug. 3, 2003

(86) PCT No.: PCT/IB03/03425

§ 371 (c)(1),
(2), (4) Date: Sep. 23, 2005

(87) PCT Pub. No.: WO2004/017359

PCT Pub. Date: Feb. 26, 2004

(65) Prior Publication Data

US 2006/0145624 A1 Jul. 6, 2006

(30) Foreign Application Priority Data

Aug. 16, 2002 (DE) ..... 102 37 598

(51) Int. Cl.

| | |
|---|---|
| ***H01J 17/00*** | (2006.01) |
| ***H01J 61/00*** | (2006.01) |
| ***H01J 61/35*** | (2006.01) |
| ***H01J 61/12*** | (2006.01) |
| ***H01J 17/20*** | (2006.01) |

(52) U.S. Cl. ..... 313/634; 313/567; 313/573; 313/637; 313/635; 313/643

(58) Field of Classification Search ..... 313/634, 313/573, 493

See application file for complete search history.

(56) References Cited

U.S. PATENT DOCUMENTS

| | | | | |
|---|---|---|---|---|
| 2,806,968 | A * | 9/1957 | Thorington et al. | 313/25 |
| 3,384,771 | A | 5/1968 | Pomfrett | |
| 3,668,455 | A * | 6/1972 | Dale et al. | 313/486 |
| 5,556,191 | A | 9/1996 | Maassen | |
| 5,708,331 | A * | 1/1998 | Vamvakas et al. | 315/248 |
| 5,723,937 | A * | 3/1998 | Whitman et al. | 313/116 |
| 5,952,784 | A | 9/1999 | Witting | |
| 6,137,230 | A * | 10/2000 | Born et al. | 313/638 |
| 2002/0047523 | A1 | 4/2002 | Van Dommelen et al. | |
| 2002/0135304 | A1 * | 9/2002 | Honda et al. | 313/634 |

FOREIGN PATENT DOCUMENTS

| | | |
|---|---|---|
| DE | 19834401 A1 | 2/2000 |
| DE | 19910709 A1 | 9/2000 |
| EP | 1032010 A1 | 8/2000 |
| WO | WO0217350 A1 | 2/2002 |

* cited by examiner

*Primary Examiner*—Nimeshkumar D. Patel
*Assistant Examiner*—Natalie K Walford

(57) ABSTRACT

A mercury-free gas discharge lamp suitable in particular for motor vehicles has an enhanced discharge arc diffuseness. The lamp according includes an inner vessel and/or outer bulb with a structured arrangement or pattern such that the discharge arc diffuseness of the lamp is increased, such as by 0.01 mm to 1.5 mm.

21 Claims, 4 Drawing Sheets

Figure 1:
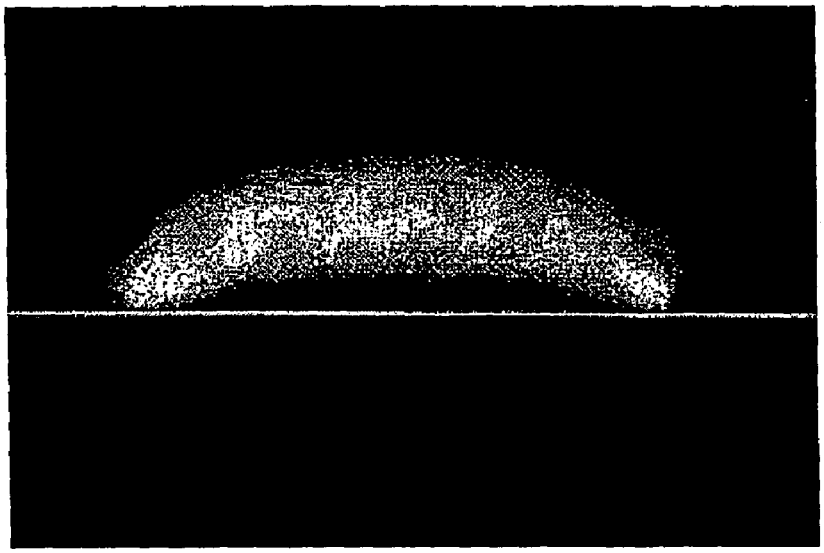

Discharge arc comparison Hg / Hg-free with Hg

Hg-free lines without overlaps lines with overlaps

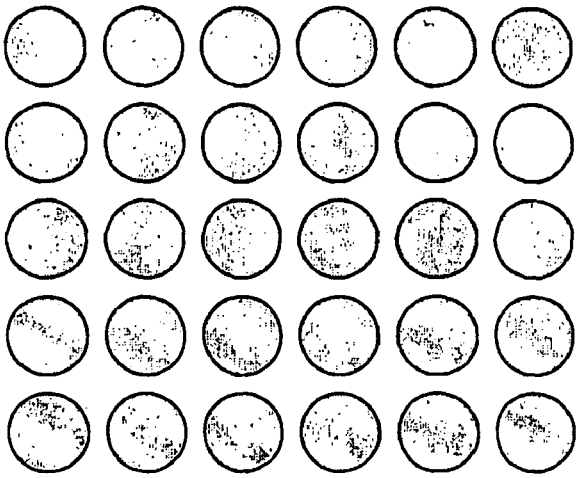
basic pattern without overlaps FIG.5
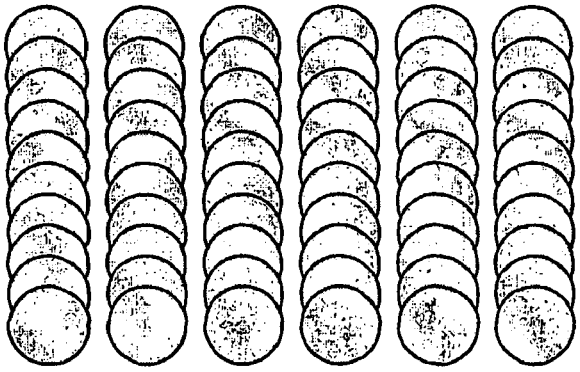
basic pattern with overlaps in rows or columns FIG.6
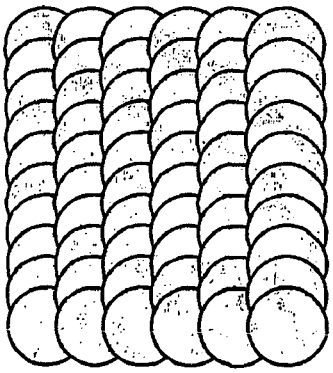
basic pattern with overlaps in rows and columns FIG.7

INCREASING THE DISCHARGE ARC DIFFUSENESS IN MERCURY-FREE DISCHARGE LAMPS

The invention relates to a mercury-free gas discharge lamp, suitable in particular for motor vehicles, with an increased discharge arc diffuseness, to its use, and to a method of its manufacture.

Gas discharge lamps are generally known in the prior art. Mercury-xenon high-pressure gas discharge lamps, denoted D1 and D2 xenon lamps, are generally used nowadays in the headlight systems of many motor vehicles.

More and more, mercury-free gas discharge lamps are entering the market at present. These are mercury-free xenon high-pressure gas discharge lamps denoted D3 and D4 xenon lamps. An essential disadvantage in mercury-free gas discharge lamps optimized for a high luminous efficacy is that the diffuseness of the discharge arc formed between the electrodes is substantially smaller because of the absence of mercury as compared with corresponding gas discharge lamps that do contain mercury. This leads to a clearly less diffuse discharge arc in mercury-free gas discharge lamps. It is in particular in reflection headlight systems, whose reflectors are often adapted highly accurately to the discharge arc geometry, that a discharge arc of insufficient diffuseness can lead to a permanent, uneven illumination of the field in front of the vehicle, i.e. independently of whether the motor vehicle is stationary or is accelerating.

DE-A1 198 34 401 discloses a mercury high-pressure gas discharge lamp for a motor vehicle with a burner space in whose inner vessel two electrodes are arranged between which a discharge arc is ignited, and with an outer bulb surrounding the burner. The burner or the outer bulb comprises a homogeneous layer of light-scattering nuclei (diffuser). An imaging error, which is perceivable as a vibration of the front field illumination, is avoided or substantially reduced thereby in projection headlight systems in the case of a vertical acceleration of the motor vehicle. In the case of a vertical acceleration, the discharge arc may change its location relative to the headlight system because of the mass inertia of the plasma. This leads to an imaging error of the discharge arc which is unpleasantly perceivable as a vibration of the front field illumination. To avoid the vibration of the illumination, DE-A1 198 34 401 proposes that the burner or the outer bulb has a homogeneous layer of light-scattering nuclei (milk glass).

DE-A1 199 10 709 discloses a mercury high-pressure gas discharge lamp whose lamp body is at least partly frosted so as to avoid vibration of the illumination during an acceleration of motor vehicles, which frosting has the effect that it is impossible to look directly into the burner space from outside the lamp body.

It is a disadvantage that a milky or frosted diffuser layer is necessary for avoiding a vibration of the illumination. This leads to light losses of these mercury high-pressure gas discharge lamps of at least 100 lumens.

It is an object of the present invention to increase the diffuseness of the discharge arc in mercury-free gas discharge lamps, which diffuseness is caused by the narrower discharge arc and is insufficient, so as to render possible, for example, their use in motor vehicles with reflection or projection headlight systems adapted for mercury-containing lamps.

According to the invention, this object is achieved in that, in a mercury-free gas discharge lamp having an inner vessel and an outer bulb, the inner vessel and/or the outer bulb has a structured arrangement.

The expression "inner vessel" and the expression "outer bulb" used in the present description comprise all conceivable suitable vessel shapes.

Apart from the adaptation of the discharge arc diffuseness, the method according to the invention in addition achieves an adaptation of the arc curvature which is different in mercury-free lamps as compared with mercury-containing lamps under certain circumstances. This renders it easier for the headlight manufacturer to use adequate headlight systems, and in addition renders possible the replacement of lamps containing mercury presently in use with mercury-free lamps.

According to the invention, the structured arrangement is made such that the discharge arc curvature of the mercury-free gas discharge lamp with a structured arrangement is reduced by dK 0.01 mm up to dK 0.5 mm, preferably by dK 0.03 mm up to dK 0.2 mm, more preferably by dK 0.05 mm up to dK 0.1 mm in comparison with the corresponding gas discharge lamp without structured arrangement.

The arc curvature is stronger in mercury-free gas discharge lamps optimized for a high luminous efficacy than in corresponding gas discharge lamps that do contain mercury. The structured arrangement according to the invention above the brightest spot leads to an optical change in the position or location of the brightest spot because of this structured arrangement, i.e. the brightest spot of the discharge arc appears to an external observer to be in a different location when viewed from that external direction owing to the structured arrangement, so that the optical impression of a change of position of the brightest spot of the discharge arc is created. It should be emphasized that obviously the brightest spot of the discharge arc is not shifted inside the discharge arc itself by the measure according to the invention, but that merely the impression is created to an external observer of the mercury-free gas discharge lamps that the brightest spot of the discharge arc has shifted from its original position.

It is advantageous if the structured arrangement is made such that the increase in diffuseness of the discharge arc of the mercury-free gas discharge lamp with structured arrangement amounts to dD 0.01 mm up to 1.5 mm, preferably dD 0.05 mm up to 0.9 mm, and particularly dD 0.1 up to 0.6 mm in comparison with the gas discharge lamp without structured arrangement. In particular, the increase in diffuseness of the discharge arc dD may be in particular $dD \leqq 0.01$ mm; $dD \leqq 0.2$ mm; $dD \leqq 0.3$ mm; $dD \leqq 0.4$ mm; $dD \leqq 0.5$ mm; $dD \leqq 0.6$ mm; or $dD \leqq 0.7$ mm.

In contrast to the illumination vibration described for the prior art, where the plasma changes its position with respect to the headlight system owing to its mass inertia in the case of a vertical acceleration of the discharge arc, the discharge arc in a mercury-free gas discharge lamp, i.e. the plasma of the discharge arc, tends to be of a narrower shape during stationary operation especially for high luminous fluxes as compared with similar mercury high-pressure gas discharge lamps, i.e. the plasma volume expansion in mercury-free gas discharge lamps is clearly smaller than in corresponding mercury high-pressure gas discharge lamps. The present invention accordingly does not have for its object the avoidance of an illumination vibration caused by a vertical acceleration, in which the discharge arc merely changes its position with respect to the headlight system because of the mass inertia of the plasma, but instead to increase the insufficient diffuseness of the discharge arc in mercury-free gas discharge lamps optimized for a high luminous efficacy, which lesser diffuseness is caused by the smaller plasma volume as compared with corresponding mercury high-pressure gas discharge lamps.

The light losses of the mercury-free gas discharge lamps according to the invention with structured arrangements as compared with gas discharge lamps without structured arrangements amount to ≦90 lumens and ≧5 lumens, preferably ≦60 lumens and ≧10 lumens, and more preferably ≦50 lumens and ≧30 lumens.

The construction principle of a mercury-free gas discharge lamp according to the invention involves an inner vessel with a burner space, with two electrodes arranged in the inner vessel between which a discharge arc is ignited, and possibly an outer bulb. The inner bulb, also denoted burner hereinafter, may be filled with xenon gas and further ionizable luminous substances. Two electrodes are fused into the inner vessel on either side of the discharge space. The application of a voltage to the electrodes ignites and maintains a gas discharge between them. The discharge arc lies above the connecting line between the electrodes because of the thermal rise. The transition regions between the electrodes and the discharge arc are denoted the focal spots. The focal spots are the hottest and brightest spots of the discharge arc.

Mercury-free gas discharge lamps according to the invention may be used in motor vehicles, for example in reflection headlights or projection headlights, in slide projectors, movie projectors, luminaires, etc. The mercury-free gas discharge lamps according to the invention may be used in principle for the entire range of illumination applications.

In a preferred embodiment of the present invention, the mercury-free gas discharge lamp is a mercury-free high-pressure gas discharge lamp, preferably a mercury-free xenon high-pressure gas discharge lamp.

The inner vessel and/or outer bulb of a mercury-free gas discharge lamp according to the invention may be made of a material chosen from the group comprising glass and/or ceramic materials, the inner vessel and outer bulb being preferably made of glass.

It is preferred that the inner vessel and/or outer bulb has a structured arrangement on its outer surface facing away from the discharge arc, on its outer surface facing the discharge arc, and/or within the vessel or bulb material layer itself. The latter may be achieved, for example, by means of a special doping of the glass or a volume-affecting laser treatment, i.e. structuring. In one embodiment, a surface of at least one of the inner vessel and the outer bulb is altered to form a pattern configured to increase a diffuseness of the discharge arc.

The inner vessel and/or outer bulb according to the invention may comprise a homogeneous and/or inhomogeneous structured arrangement, which structured arrangement is preferably formed by sandblasting, laser treatment, surface etching, surface slitting and/or roughening, and is possibly finished by a thermal treatment, for example fire polishing. Thus it is possible for the inner vessel and/or outer bulb to comprise several mutually attuned or non-attuned surfaces which make for a homogeneous or inhomogeneous structured arrangement. It is possible in this manner for the inner vessel and/or outer bulb to comprise several surfaces of different structures, homogeneously structured surfaces as well as inhomogeneously structured surfaces. The structured surfaces may be arranged in rings. Alternatively, however, the structured surfaces may be polygonal, preferably rectangular.

It is advantageous when the outer bulb or inner vessel comprises a structured surface with a size of 2 $mm^2$ up to 12 $mm^2$ in relation to the respective structured bulb or vessel, wherein the surface with structured arrangement is preferably provided over the brightest spot in the discharge arc. The structured surface may in particular cover a surface area of 3 $mm^2$, 5 $mm^2$, 7 $mm^2$, or 10 $mm^2$. The structured surface may be formed on the outer bulb and/or inner vessel in radial direction so as to be partly or fully circumferential. Preferably, the structured surface is centrally provided on the outer bulb and/or inner vessel in radial direction so as to be partly or fully circumferential.

The lateral regions of the outer bulb and/or inner vessel are preferably without structured arrangements.

It is particularly preferred that the burner space is visible laterally from the outside. The focal spots of the plasma arc present at the electrodes must not be covered here, because this adversely affects the light beam in the headlight.

The surface area free from structures of the outer bulb and/or inner vessel amounts to ≧10%, in particular ≧20%, preferably ≧30%, more preferably ≧40%, even more preferably ≧50% of the respective outer bulb and/or inner vessel surface having a structured arrangement. The surface area free from structured arrangements of the outer bulb and/or inner vessel may alternatively amount to ≧60%, in particular ≧70%, preferably ≧80%, more preferably ≧90%, even more preferably ≧95% of the respective outer bulb and/or inner vessel surface having a structured arrangement.

In an embodiment of the invention, a structured arrangement may be formed within the material layer of the inner vessel and/or outer bulb. In principle, a structuring of the inner vessel and/or outer bulb may be formed on the outer surface(s) facing away from the discharge arc, on the outer surface(s) facing the discharge arc, and/or within the material layer of the bulb or vessel.

The structured arrangement of the inner vessel and/or outer bulb may be created in a first step by means of etching, sandblasting, grinding, and/or a laser treatment, whereupon possibly the structured arrangement thus created is finished in a second step by a thermal method, for example fire polishing. A structured arrangement within a material layer of the inner vessel and/or outer bulb is advantageously achieved by means of a laser.

Suitable structure patterns comprise lines, dots, circles, rectangles, polygons, combinations thereof, and superimpositions thereof. The lines may be straight, curved, wavy, spiraling, etc. The dots, circles, rectangles, polygons, etc. may be of the same or of different sizes, and they may be partly or fully planar in shape. It is advantageous for obtaining an inhomogeneous structured arrangement when different structure patterns are superimposed on one another.

A laser may be used for forming the structured arrangement, preferably a laser whose wavelength range is sufficiently absorbed by the material to be structured, for example a $CO_2$ laser in the wavelength range of 10,600 nm. A laser in a different wavelength range is also possible, depending on the absorption behavior of the glass.

If a laser is used for making the structured arrangement for whose wavelength range the material under treatment has an insufficient absorption, the application of a separate absorption layer is necessary. Those materials are to be preferred for this absorption layer which have as low an evaporation temperature as possible, so that the layer will evaporate without residue during the treatment with the laser beam.

Structuring of the glass in the case of an added absorption layer is safeguarded in that the coating is heated to evaporation point and the subjacent glass is heated along therewith in the boundary layer so strongly that glass is locally partly cracked off and/or evaporated or melted.

To achieve a defined structured arrangement of the glass surface, a scanner arranged downstream of the laser may be used, which deflects the laser beam in a variable manner in accordance with the surface to be processed. Alternatively, a two- or three-dimensional linear system is conceivable in combination with a stationary laser beam, on which system the work piece to be treated is held in a defined position.

The provision of a structured basic pattern, for example dots, may be varied through variation of distances, degrees of overlap, sizes, laser beam power, and/or advancing speed, depending on how much the diffuseness is to be increased at the respective working point.

A structured arrangement may also be applied by means of sandblasting and/or a grinding medium, such that the outer bulb and/or inner vessel is superficially cut. To achieve a discharge arc diffuseness of approximately dD 0.3 mm, it may be advantageous to give the structured surface an after-treatment in a subsequent thermal step, for example by fire polishing. This renders possible on the one hand very small diffuseness changes, for example of dD≦0.3 mm, and also a finer adaptation of the corresponding discharge arc diffuseness, i.e. a graduation of a higher resolution. In addition, fire polishing has the further advantage that the light transmission remains intact, so that substantially lower lumen losses occur.

A particularly preferred embodiment of the present invention is accordingly formed by a mercury-free lamp with a surface structured in accordance with the invention, which surface has been fire-polished.

Figure 2:
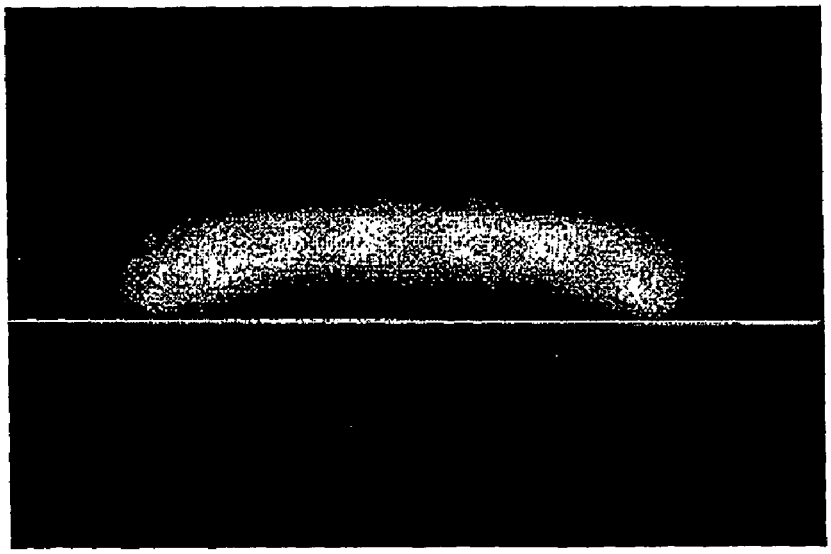
Figure 3:
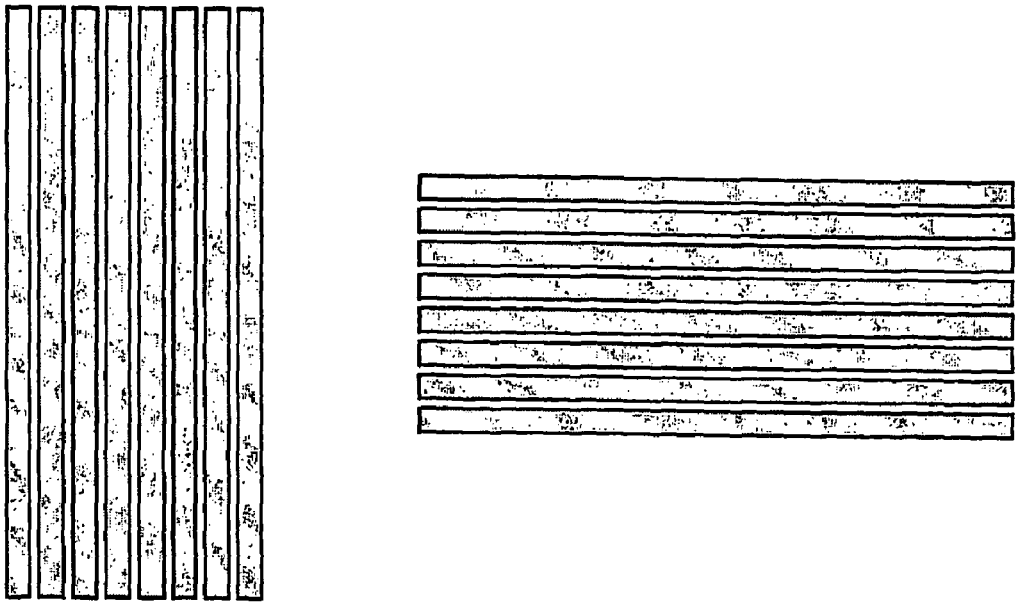
Figure 4:
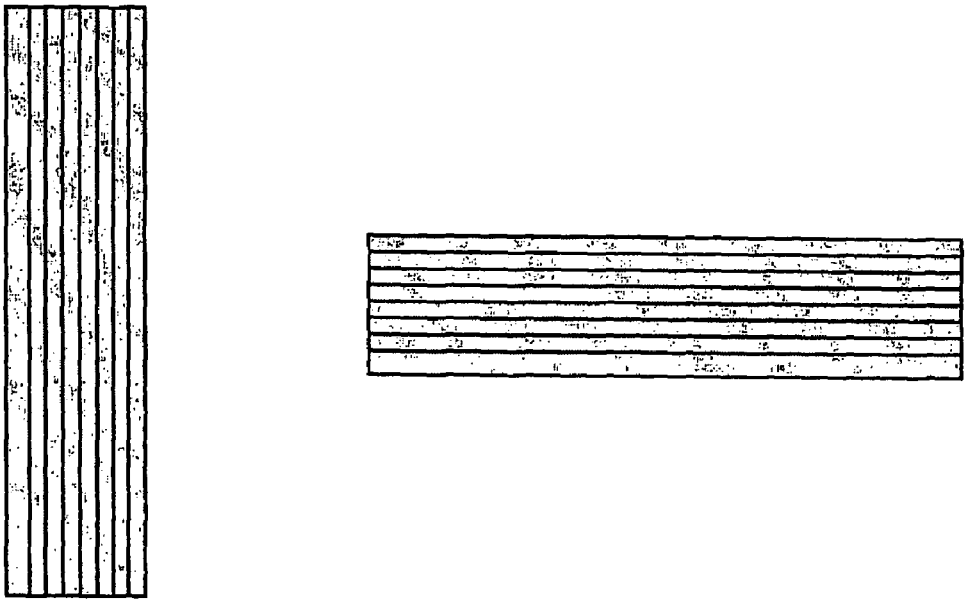
Figure 8:
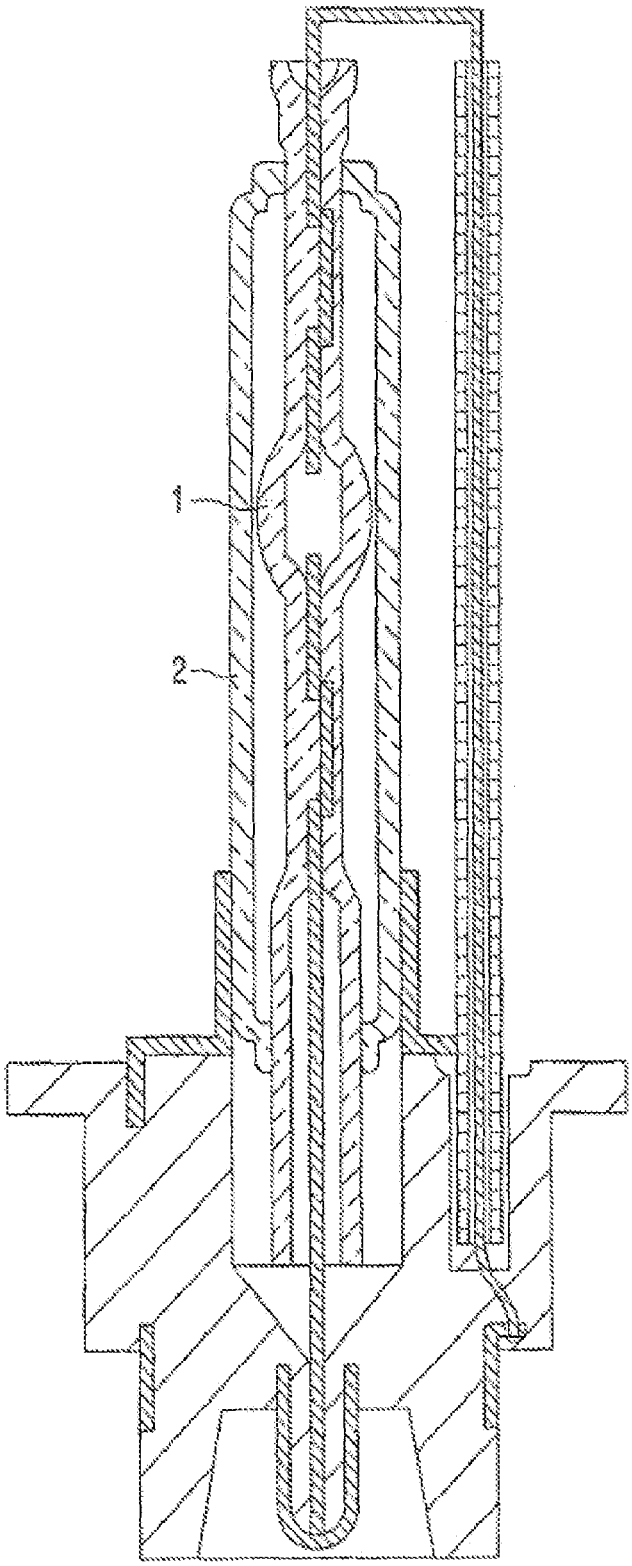

The subject of the present invention will be explained in more detail below with reference to the accompanying FIGS. 1 to 7, in which:

FIG. 1 shows a discharge arc of a gas discharge lamp containing mercury,

FIG. 2 shows a discharge arc of a mercury-free gas discharge lamp optimized for a high luminous efficacy, FIG. 3 shows a basic pattern without linear overlap, FIG. 4 shows a basic pattern with linear overlap, FIG. 5 shows a basic pattern of circles without overlap, FIG. 6 shows a basic pattern with overlapping circles arranged in rows or columns, FIG. 7 shows a basic pattern with circles overlapping in rows and Columns, and FIG. 8 shows a lamp according to one embodiment of the present invention.

FIG. 1 shows a discharge arc of a gas discharge lamp that contains mercury. The so-termed focal spots can be seen at the respective ends of the discharge arc. The discharge arc has its maximum height in the center between the two focal spots.

FIG. 2 shows a discharge arc of a mercury-free gas discharge lamp without structured arrangement. The so-termed focal spots can be seen at the ends of the discharge arc. The discharge arc has its maximum height in the center between the two focal spots. The discharge arc has a substantially narrower, more strongly curved shape than the discharge arc of the gas discharge lamp with mercury. It is apparent that the height of the discharge arc in the center between the two focal spots is substantially lower than in the discharge arc of a gas discharge lamp with mercury.

FIG. 8 shows a lamp according to one embodiment of the present invention. As shown in FIG. 8, the lamp includes an inner vessel or burner 1 and an outer envelope or bulb 2.

FIGS. 3 to 7 show advantageous basic pattern structures. These basic pattern structures may be superimposed. Homogeneous or inhomogeneous structures may be formed, in dependence on the combinations of structuring patterns.

The manufacture of the mercury-free gas discharge lamps according to the invention with structured outer bulbs and/or inner vessels will be explained in more detail below with reference to the following examples 1 to 3.

EXAMPLE 1

A laser beam was directed at an outer surface of a blank for an outer bulb. Alternatively, the laser may be directed at an outer bulb that has already been mounted around the burner. The laser used was a $CO_2$ laser with a wavelength range of 10,600 nm. To give the glass surface a defined structure, a scanner was used downstream of the laser, which scanner deflects the laser beam in a variable manner in accordance with the surface to be treated. An inhomogeneous structured arrangement was provided by a suitable pulsatory operation of the laser beam such that the size of the structured surface was 10 $mm^2$ and the light losses were <50 lumens. The increase in diffuseness of the discharge arc of the mercury-free gas discharge lamp with a structured arrangement was approximately dD 0.9 mm in comparison with the gas discharge lamp without structured arrangement.

EXAMPLE 2

A laser beam was directed at the outer surface of an inner vessel, i.e. a burner vessel. The laser used was a $CO_2$ laser with a wavelength range of 10,600 nm. To give the glass surface a defined structure, a scanner was used downstream of the laser, which scanner deflects the laser beam in a variable manner in accordance with the surface to be treated. An inhomogeneous structured arrangement was provided by a suitable pulsatory operation of the laser beam such that the size of the structured surface was 8 $mm^2$ and the light losses were <30 lumens. The increase in diffuseness of the discharge arc of the mercury-free gas discharge lamp with a structured arrangement was approximately dD 0.7 mm in comparison with the gas discharge lamp without structured arrangement.

EXAMPLE 3

A structure was provided on an outer bulb by sandblasting. A fire-polishing treatment was carried out subsequently so as to achieve an increase in diffuseness of the discharge arc of approximately dD 0.3 mm. The size of the structured surface was 8 $mm^2$ and the light losses amounted to <20 lumens.

The measuring methods used will be described below.

Light Losses (Lumens)

The light losses (in lumens) were measured in a so-termed Ulbricht globe photometer. An Ulbricht globe photometer is a metal globe with an ideally reflecting inner paint coat for an integral measurement of the luminous flux of the lamp which is fastened in a lamp holder in the globe center. The reflected light is incident on a photocell which is arranged behind an ideally reflecting screen which protects the photocell from directly incident light. The sphere used had a diameter of 0.8 m. A wattmeter and a colorimeter were connected. The run-up behavior, i.e. the amount of light emitted by the mercury-free gas discharge lamp according to the invention during the first 5 seconds after switching-on as compared with the corresponding, non-structured lamp is graphically represented on a measuring PC. All test results relate to the steady state, unless indicated to the contrary, i.e. to a measurement taking place after 3 min at rated power and after a constant temperature has been achieved.

Discharge Arc Diffuseness (mm)

The discharge arc diffuseness (mm) was measured in a mercury-free gas discharge lamp structured in accordance with the invention and the corresponding mercury-free gas discharge lamp without structure in that in each case the distance was measured between those points of the discharge arc in the region of the light center length between the two electrodes which have 20% of the maximum relative luminous intensity at the upper and the lower edge of the discharge arc. The measurements were carried out in accordance with the United Nations Economic Communication (UNECE), Regulation No. 99, Uniform provisions concerning approval of gas discharge light sources for use in approved gas discharge lamp units of power driven vehicles, 15 Apr. 1996.

dD=discharge arc diffuseness (inv. structure)−discharge arc diffuseness (without structure)

dD=increase in discharge arc diffuseness discharge arc diffuseness (inv. structure)=arc diffuseness (mm) of a mercury-free gas discharge lamp structured in accordance with the invention discharge arc diffuseness (without structure)=discharge arc diffuseness (mm) of an identical mercury-free gas discharge lamp but without structuring.

Discharge Arc Curvature

The discharge arc diffuseness (mm) was measured in that the distance of the brightest spot in the discharge arc to the line of symmetry of the electrodes was measured in the region of the light center length for a mercury-free gas discharge lamp with a structured arrangement according to the invention and the corresponding mercury-free gas discharge lamp without structure each time.

Discharge Arc Curvature (mm)

The discharge arc curvature (mm) was measured in that the distance of the brightest discharge arc point to the line of symmetry of the electrodes was determined in the region of the light center length. The measurements were carried out in accordance with the United Nations Economic Communication (UNECE), Regulation No. 99, Uniform provisions concerning approval of gas discharge light sources for use in approved gas discharge lamp units of power driven vehicles, 15 Apr. 1996.

dK=discharge arc curvature (without structure)−discharge arc curvature (inventive structure)

dK=reduction in discharge arc curvature discharge arc curvature (inventive structure)=discharge arc curvature (mm) of a mercury- free gas discharge lamp with a structured arrangement according to the invention discharge arc curvature (without structure)=discharge arc curvature (mm) in an identical mercury-free gas discharge lamp but without structured arrangement.

The invention claimed is:

1. A mercury-free gas discharge lamp comprising:

an inner vessel including electrodes for providing a discharge arc; and an outer bulb, wherein a surface of at least one of the inner vessel and the outer bulb is altered to form a pattern configured to increase a diffuseness of the discharge arc, wherein the pattern includes structured arrangements formed on the surface, the structured arrangements physically overlapping over each so that a first structured arrangement is in physical contact with a second structured arrangement.

2. The mercury-free gas discharge lamp as claimed in claim 1, wherein the pattern is configured to increase the diffuseness of the discharge arc of the mercury-free gas discharge lamp by 0.01 mm up to 1.5 mm in comparison with a corresponding gas discharge lamp without the pattern.

3. The mercury-free gas discharge lamp as claimed in claim 1, wherein the pattern is configured to reduce the discharge arc curvature of the mercury-free gas discharge lamp by 0.01 mm up to 0.5 mm in comparison with a corresponding gas discharge lamp without the pattern.

4. The mercury-free gas discharge lamp as claimed in claim 1, wherein the mercury-free gas discharge lamp is at least one of a mercury-free high-pressure gas discharge lamp, and a mercury-free xenon high-pressure gas discharge lamp.

5. The mercury-free gas discharge lamp as claimed in claim 1, wherein light losses of the mercury-free gas discharge lamp as compared with a gas discharge lamp without the pattern amount to $\leqq 90$ lumens and $\geqq 5$ lumens.

6. The mercury-free gas discharge lamp as claimed in claim 1, wherein the at least one of the inner vessel and the outer bulb is made of at least one of glass and ceramic materials.

7. The mercury-free gas discharge lamp as claimed in claim 1, wherein the at least one of the inner vessel and the outer bulb has the pattern at least one of on its outer surface facing away from the discharge arc, on its outer surface facing the discharge arc, and within the inner vessel or bulb material.

8. The mercury-free gas discharge lamp as claimed in claim 1, wherein the pattern is formed by at least one of a laser treatment, sandblasting, surface etching, surface slitting and roughening, and is optionally finished by fire polishing.

9. The mercury-free gas discharge lamp as claimed in claim 1, wherein the pattern covers a surface area of 2 $mm^2$ to 12 $mm^2$, said surface area being arranged over a brightest spot in the discharge arc.

10. The mercury-free gas discharge lamp as claimed in claim 1, wherein the mercury-free gas discharge lamp is configured for motor vehicles.

11. The mercury-free gas discharge lamp of claim 1, wherein the pattern is further configured to provide an optical impression when viewed from an exterior of the mercury-free gas discharge lamp, the optical impression showing a change in a viewed position of a brightest spot of the discharge arc despite lack of an actual change of an actual position of the brightest spot within the mercury-free gas discharge lamp.

12. The mercury-free gas discharge lamp of claim 1, wherein the pattern is further configured to not change an actual position of a brightest spot of the discharge arc and yet provide an optical impression showing a perceived change in a perceived position of a brightest spot when viewed from an exterior of the mercury-free gas discharge lamp.

13. The mercury-free gas discharge lamp of claim 1, wherein the pattern includes at least one of lines, dots, circles, rectangles, and polygons.

14. The mercury-free gas discharge lamp of claim 13, wherein the lines includes at least one of straight, curved, wavy, and spiraling lines.

15. The mercury-free gas discharge lamp of claim 13, wherein the structured arrangements are at least one of same and different sizes, and are partly or fully planar in shape.

16. The mercury-free gas discharge lamp of claim 1, wherein the structured arrangements are at least one of partly and fully planar.

17. A discharge lamp comprising:

an inner vessel including electrodes for providing a discharge arc; and an outer bulb, wherein at least one of the inner vessel and the outer bulb is altered to form a pattern configured to increase a diffuseness of the discharge arc, wherein the pattern includes structured arrangements that are physically overlapping over each other so that a first structured arrangement is in physical contact with a second structured arrangement.

18. The discharge lamp of claim 17, wherein the pattern is further configured to provide an optical impression when viewed from an exterior of the discharge lamp, the optical impression showing a change in a viewed position of a brightest spot of the discharge arc despite lack of an actual change of an actual position of the brightest spot within gas discharge lamp.

19. The discharge lamp of claim 17, wherein the pattern is further configured to not change an actual position of a brightest spot of the discharge arc and yet provide an optical impression showing a perceived change in a perceived position of a brightest spot when viewed from an exterior of the discharge lamp.

20. The discharge lamp of claim 1, wherein the pattern includes homogeneously overlapping rings arranged in at least one of row and columns formed by at least one of a laser treatment, sandblasting, surface etching, surface slitting and roughening.

21. The discharge lamp of claim 17, wherein the pattern includes homogeneously overlapping rings arranged in at least one of row and columns formed by at least one of a laser treatment, sandblasting, surface etching, surface slitting and roughening.

* * * * *